US005603140A

United States Patent [19]

Pryce

[11] Patent Number: 5,603,140

[45] Date of Patent: Feb. 18, 1997

[54] FURNITURE PROTECTING DEVICE

[76] Inventor: Stephen Pryce, 453 Parliament St., Suite #3, Toronto, Ontario, Canada, M5A 3A3

[21] Appl. No.: 583,631

[22] Filed: Jan. 5, 1996

[51] Int. Cl.[6] ..... B60B 33/00

[52] U.S. Cl. ..... 16/18 CG; 16/42 R; 248/345.1

[58] Field of Search ..... 16/18 CG, 42 R, 16/DIG. 2; 248/345.1

[56] References Cited

U.S. PATENT DOCUMENTS

| | | | |
|---|---|---|---|
| 70,490 | 11/1867 | Winchester . | |
| D. 166,618 | 4/1952 | Mince | D15/1 |
| 179,690 | 7/1876 | Evans | 248/345.1 |
| 1,420,602 | 6/1922 | Wujek . | |
| 1,486,267 | 3/1924 | Salomon . | |
| 1,921,561 | 8/1933 | Christmas . | |
| 2,107,629 | 2/1938 | Dallas | 16/42 R |
| 2,110,005 | 3/1938 | Rees . | |
| 4,700,430 | 10/1987 | Raftery | 16/42 R |
| 5,173,990 | 12/1992 | Owen | 16/18 |
| 5,369,925 | 12/1994 | Vargo | 248/345.1 |
| 5,371,920 | 12/1994 | Rainville | 16/18 |

*Primary Examiner*—Chuck Y. Mah
*Attorney, Agent, or Firm*—Smith Patent Office

[57] ABSTRACT

A device for protecting the leg or corner of a piece of furniture from damage is disclosed. The device includes an elongate shield member that encompasses at least the lower front portion of the leg or corner of a piece of furniture. A foot member, for positioning under the leg or corner of the furniture, is attached to the lower end of the elongate shield member forming a generally right angle therewith. The elongate shield member includes a series of breakaway or cutaway lines that comprise linear zones of structural weakness such that portions of the shield member can be readily broken off to enable the shape of the device to be altered thereby accommodating the shape of the leg or corner of the furniture to which it is applied.

8 Claims, 2 Drawing Sheets

FURNITURE PROTECTING DEVICE

FIELD OF THE INVENTION

This invention relates to protective devices for placement around the legs or corners of pieces of furniture in order to protect the furniture from accidental damage and scratching.

BACKGROUND OF THE INVENTION

The legs or corners of pieces of furniture, including chairs, tables, sofas, desks and the like, are often subjected to damage from a variety of sources. Furniture legs and corners may be scratched or damaged by shoes or boots, by household pets, by children or their toys, or through coming into contact with cleaning appliances such as vacuum cleaners. Depending upon the nature of the furniture and the type of damage it has sustained, fixing the damage is not always possible. In cases where the damage can be fixed, to do so often requires removal of the furniture, the services of a professional and considerable inconvenience and expense.

While others have recognized the need to protect the legs and corners of furniture from the types of damage described above, prior protective devices have been clumsy looking, awkward to install, unable to be easily adapted to fit varying sizes and shapes of furniture legs and corners, and have tended to be too expensive to allow for extensive and broad based use.

SUMMARY OF THE INVENTION

The invention therefore provides a device that may be used to protect a leg or corner of a piece of furniture from damage. The device is preferably comprised of inexpensive materials to reduce the cost, is transparent so as not to detract from the appearance of the furniture in an excessive manner, and is readily adaptable in size to accommodate applications of varying shape and dimension.

Accordingly, the present invention in one of its aspects, provides a device for protecting the leg or corner of a piece of furniture from damage, the device comprising: (i) an elongate shield member having an upper and a lower end, said shield member encompassing at least the lower front proportion of said leg or corner of said piece of furniture; (ii) a foot member for positioning under said leg or corner of said piece of said furniture, said foot member attached to said lower end of said elongate shield member and forming a generally right angle therewith, said foot member, when positioned under the bottom surface of said leg or corner of said piece of furniture, securing said elongate shield member in close proximity to at least the lower front portion of said leg or corner of said piece of furniture; said elongate shield member having a series of breakaway lines comprising linear zones of structural weakness in said shield member such that portions of said shield member may be readily broken off along said breakaway lines to enable the shape of said shield member to be altered to accommodate the shape of said front portion of said leg or corner of said piece of furniture.

In a further embodiment, the breakaway lines of the invention comprise a series of perforations through said elongate shield member, said perforations being arranged in close linear proximity to one another thereby forming said linear zones of structural weakness in said shield member along which a portion of said elongate shield member can be broken off such that the shape of said elongate shield member can be readily altered to accommodate the shape of said front portion of said leg or corner of said piece of furniture.

Further aspects and advantages of the invention will become apparent from the following description, taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 3:
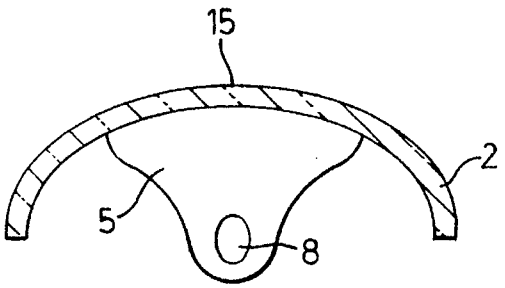
FIG. 3 is a cross sectional view of the device taken along the line 3—3 of FIG. 1.
Figure 2:
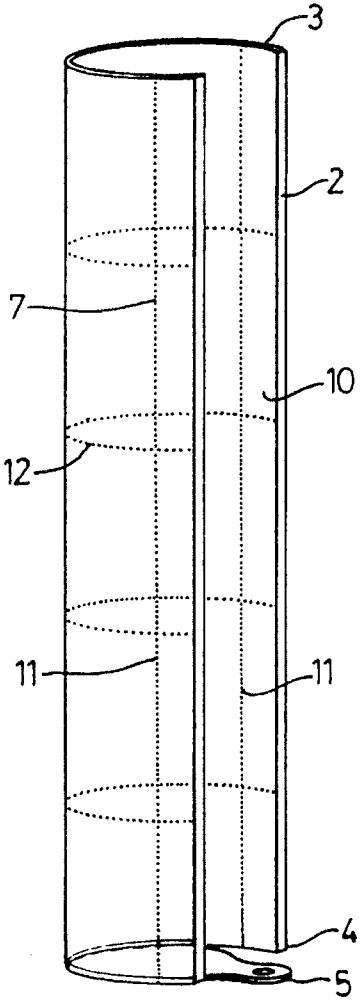
FIG. 2 is a side perspective view of the device shown in FIG. 1.
Figure 1:
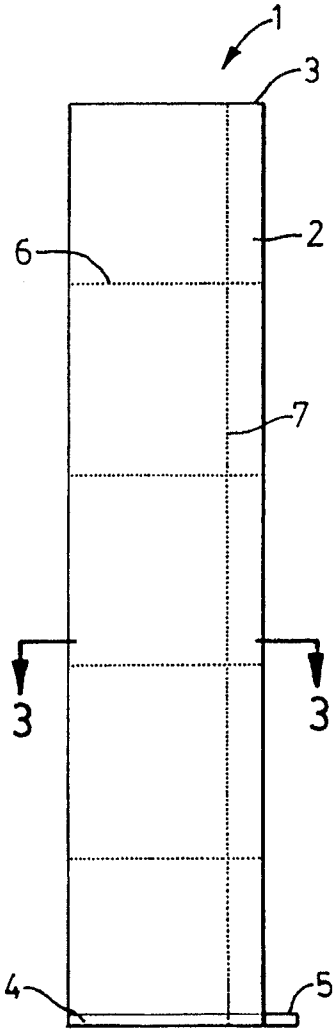
FIG. 1 is a side view of the protective device according to the present invention.

Referring to FIGS. 1, 2 and 3, the protective device of the present invention is noted generally by the reference numeral 1. Device 1 is comprised primarily of an elongate shield member 2 and a foot member 5. Elongate shield member 2 has an upper end 3, a lower end 4, a middle portion 15 and side portions 10. Foot member 5 is attached to lower end 4 of elongate shield member 2 such that foot member 5 and elongate shield member 2 form a generally right angle.

As is more clearly shown in FIGS. 2 and 3, foot member 5 is a generally planar structure constructed such that it can be easily positioned under the bottom surface of a leg of a piece of furniture, such as a table, desk or chair. It will also be appreciated that this structure enables device 1 to be readily positioned around the corner of a piece of furniture having no appreciable leg, such as a sofa or arm chair. When so positioned, foot member 5 secures elongate shield member 2 in close proximity to at least the lower front portion of the furniture leg or corner. It will be appreciated by those skilled in the art that while foot member 5 must be reasonably rigid in order to securely hold elongate shield member 2 in place, it must also be a relatively thin structure in order that the furniture is not raised an excessive amount off the floor when device 1 is used on sofas or arm chairs. It will also be appreciated that foot member 5 must extend outwardly from elongate shield member 2 to a sufficient degree so as to enable elongate shield member 2 to encompass at least the lower front portion of the furniture leg or corner when foot member 5 is positioned as discussed above.

Foot member 5 also preferably includes an oval shaped hole 8. When used in association with sofas, arm chairs and other similar furniture having no appreciable leg structure, the function of device 1 is to protect the exposed corner of the furniture (see FIG. 5). In such cases the corner of the furniture would typically rest directly on foot 5, thereby holding shield member 2 securely in place. Where the furniture to be protected is a table, desk or chair having spindle or elongate legs, the bottom of the leg will rest on foot 5 to hold device 1 in place. Where such spindle or elongate legs have sharp feet, or have bottom surfaces of small cross-sectional area, they can pass through oval shaped hole 8 such that the leg sits squarely on the floor. This will ensure that the furniture remains balanced where protective devices are not used or all the furniture's legs.

Referring now primarily to FIGS. 1 and 2, elongate shield member 2 includes a series of breakaway or cutaway lines 6 which comprise linear zones of structural weakness in shield member 2. Breakaway lines 6 are arranged as a series of longitudinal breakaway lines 11 and lateral breakaway lines 12 which from a longitudinal and lateral grid about elongate shield member 2. Breakaway lines 6 are preferably comprised of a series of perforations 7 that extend through elongate shield member 2. Perforations 7 are arranged in a generally linear pattern in close proximity to one another thereby forming said linear zones of structural weakness. The close proximity of perforations 7 allow for the controlled breakage of elongate shield member 2 along these linear zones of structural weakness.

Alternatively, breakaway lines 6 may be formed by scoring the surface of elongate shield member 2 to form said linear zones of structural weakness. Further, breakaway lines 6 may also be created through constructing elongate shield member 2 in a manner which provides for a thinning of the material comprising elongate shield member 2 along defined lines. In either case, breakage or fracturing of elongate shield member 2 will occur in a controlled and predictable manner along said breakaway lines.

Regardless of the particular form that breakaway lines 6 take, their function is the same. Through the incorporation of breakaway lines 6 in elongate shield member 2, and by arranging them in a generally longitudinal and lateral grid about elongate shield member 2, the shape of elongate shield member 2 may be altered by breaking along breakaway lines 6 and removing portions of elongate shield member 2. In this manner the physical dimensions and shape of elongate shield member 2 may be altered so as to help accommodate the shape of the front portion of the furniture leg or corner on which device 1 is to be used.

It is expected that the majority of applications for device 1 will be for use on furniture legs or corners having a generally square or circular cross-sectional shape. For that reason, as shown in the attached drawings, elongate shield member 2 is preferably of a generally quonset shape (i.e. one half of a right circular cylinder). By removing portions of elongate shield member 2 through breaking along breakaway lines 6, the generally quonset shape of elongate shield member 2 can be altered to enhance the ability of device 1 to be used on furniture legs and corners having a variety of shapes, widths and lengths.

In order to further enhance the versatility of device 1, foot member 5 is preferably attached to only middle portion 13 of the lower end 4 of elongate shield member 2. This ensures that foot member 5 rests squarely on the floor beneath the furniture (except where used on furniture with thin legs as discussed previously) while permitting side portions 10 to be removed through breaking along longitudinal breakaway lines 11 without interference from foot member 5.

Device 1 is also preferably comprised of a transparent rigid plastic material. The transparency of the material allows device 1 to be used without unnecessarily drawing attention to it when in place. Furthermore, plastic materials are relatively inexpensive from a manufacturing perspective and lend themselves to be readily broken along breakaway lines such as those that form the linear zones of structural weaknesses of device 1. Plastic materials are also reasonably durable and somewhat shock resistant thereby making them an attractive construction material for device 1.

Figure 5:
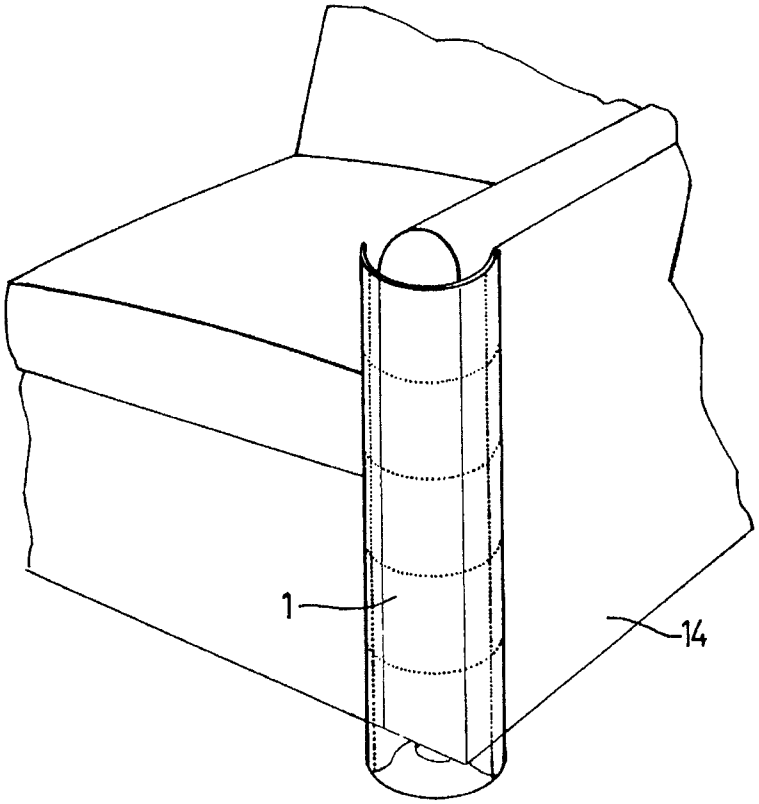
Figure 4:
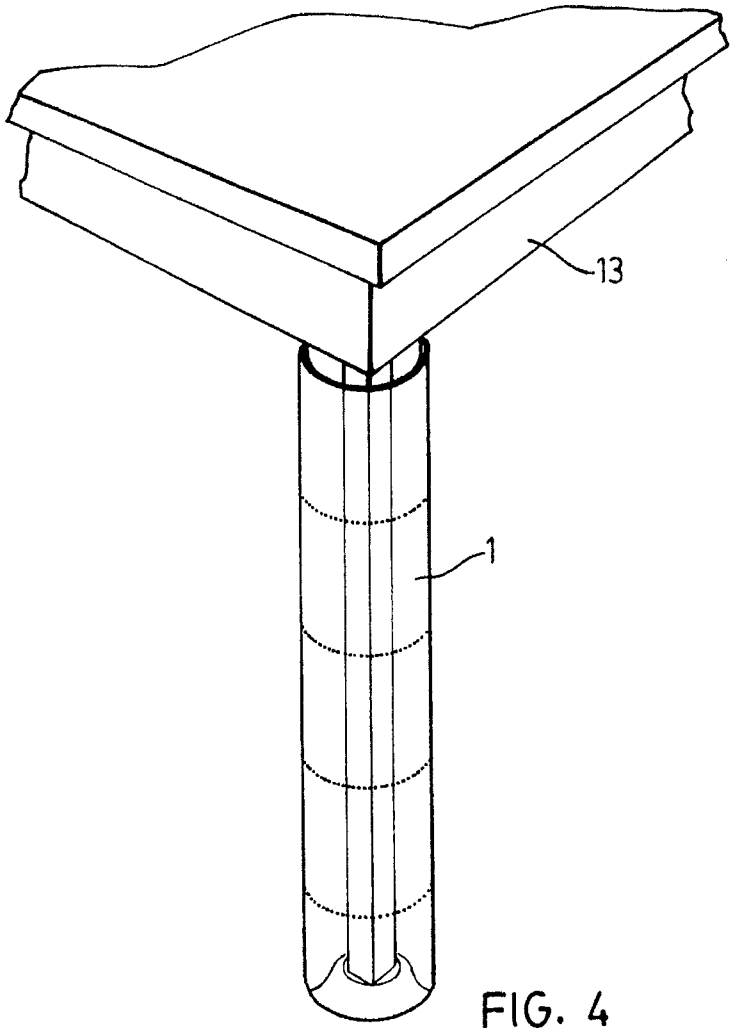
FIG. 4 is a perspective sketch showing the typical use of the device in association with the leg of a table or desk; and, FIG. 5 is a perspective sketch showing the typical use of the device in association with the corner of a sofa or chair.

In use, device 1 is typically placed next to the leg of a piece of furniture, such as may be found on a table or chair 13 as shown in FIG. 4, or around the corner of a sofa or arm chair 14 as shown in FIG. 5. When placed next to the furniture an assessment is made to determine whether the shape or dimensions of elongate shield member 2 need to be altered by the removal of portions of it. Where alteration of the shape of device 1 is necessary, portions may be removed by breaking along breakaway lines 6. To this extent, any number or combinations of portions of elongate shield member 2 may be removed to adapt elongate shield member 2 to the particular configuration of the furniture leg or corner in question.

Breakaway lines 6 are designed such that removal of pieces of elongate shield member 2 can be accomplished easily by breaking by hand or through cutting or breaking with the use of simple hand tool such as scissors or pliers. Due to the structure of breakaway lines 6, the user is able to predict precisely where elongate shield member 2 will break without the risk of fracturing in unwanted directions. Once pieces of elongate shield member 2 have been removed such that the shape of elongate shield member 2 has been altered to accommodate the shape of the front portion of the furniture leg or corner, foot member 5 is positioned under the bottom surface of the furniture leg or corner such that elongate shield member 2 is held in close proximity to at least the lower front portion of the furniture leg or corner.

It will be appreciated that device 1 therefore provides an inexpensive, aesthetically pleasing, simple to use, and efficient method to protect the legs and corners of a piece of furniture from damage. If through use device 1 becomes dirty, scratched or broken, it can be easily removed for cleaning or replacement.

It will also be appreciated that what has been described are the preferred embodiments of the invention and that it is possible to make variations to these embodiments while staying within the broad scope of the invention. Some of these variations have been discussed while others will be apparent to those skilled in the art to which this invention relates. For example, while reference has been made to breakaway lines 6 being arranged in a generally longitudinal and lateral grid about elongate shield member 2, breakaway lines 6 could also be arranged in other configurations to assist in the alteration of the shape of elongate shield member 2 such that it accommodates the shape of the furniture leg or corner. Furthermore, while in the preferred embodiment elongate shield member 2 is generally quonset in shape, it will be appreciated that other shapes could be used while still staying within the general scope of the invention.

I claim:

1. A device for protecting the leg or corner of a piece of furniture from damage, the device comprising:

(i) an elongate shield member having an upper end and a lower end for encompassing at least a lower front proportion of said leg or corner of said piece of furniture, (ii) a foot member for positioning under said leg or corner of said piece of said furniture, said foot member attached to said lower end of said elongate shield member and forming a generally right angle therewith, said foot member, when positioned under the bottom surface of said leg or corner of said piece of furniture, securing said elongate shield member in close proximity to at least the lower front portion of said leg or corner of said piece of furniture, said elongate shield member having a series of breakaway lines comprising linear zones of structural weakness in said shield member such that portions of said shield member can be readily broken off along said breakaway lines to enable the shape of said shield member to be altered to accommodate the shape of said front portion of said leg or corner of said piece of furniture.

2. The device as claimed in claim 1 wherein said breakaway lines comprise a series of perforations through said elongate shield member, said perforations being arranged in close linear proximity to one another thereby forming said linear zones of structural weakness in said shield member along which a portion of said elongate shield member can be broken off such that the shape of said elongate shield member can be readily altered to accommodate the shape of said front portion of said leg or corner of said piece of furniture.

3. The device as claimed in claim 2 wherein said breakaway lines are arranged generally in a longitudinal and lateral grid about said shield member to enable both the length and width of said shield member to be altered by removing portions of said shield member by breaking along said breakaway lines.

4. The device as claimed in claim 3 wherein said elongate shield member is substantially quonset in shape.

5. The device as claimed in claim 4 wherein said foot member is attached to said elongate shield member along the middle portion of said lower end of said elongate shield member such that said elongate shield member extends upwardly from said foot member.

6. The device as claimed in claim 5 wherein said foot member includes a generally oval shaped hole therethrough for receiving the bottom of said leg of said piece of furniture therein when said device is used on furniture having legs of small cross-sectional area, said hole allowing said furniture leg to rest on the surface upon which said piece of furniture is resting and thereby assisting in maintaining the balance of said piece of furniture.

7. The device as claimed in claim 5 comprised of a transparent rigid plastic material.

8. The device as claimed in claim 1 wherein said breakaway lines comprise a grid of linear scores in the surface of said elongate shield member, said scores representing a linear reduction in the thickness of said elongate shield member thereby forming said linear zones of structural weakness along which a portion of said elongate shield member can be broken off such that the shape of said elongate shield member can be readily altered to accommodate the shape of said front portion of said leg or corner of said leg or corner of said piece of furniture.

* * * * *